US006251049B1

(12) United States Patent
Milton

(10) Patent No.: US 6,251,049 B1
(45) Date of Patent: Jun. 26, 2001

(54) ELASTIC SWIMMING EXERCISE DEVICE

(76) Inventor: Curtis A. Milton, 4429 Widgeon Way, Tallahassee, FL (US) 32303

( * ) Notice: Subject to any disclaimer, the term of this patent is extended or adjusted under 35 U.S.C. 154(b) by 0 days.

(21) Appl. No.: 09/523,710

(22) Filed: Mar. 13, 2000

(51) Int. Cl.[7] ..... A63B 23/02
(52) U.S. Cl. ..... 482/55; 482/56; 434/254
(58) Field of Search ..... 482/111, 124, 482/105, 55, 74, 56, 148; 434/254

(56) References Cited

U.S. PATENT DOCUMENTS 5,344,373 * 9/1994 Greene ..... 482/55
5,846,167 * 12/1998 Liu et al. ..... 482/55
5,951,443 * 9/1999 Askins ..... 482/74

* cited by examiner

*Primary Examiner*—Glenn E. Richman
(74) *Attorney, Agent, or Firm*—John Wiley Horton

(57) ABSTRACT

A device for maintaining a relatively fixed position of a person exercising in a pool. The device uses a flexible rod which deforms elastically as the swimmer exercises. In this fashion, the swimmer is given feedback as to how strenuously he or she is exercising. The device can be anchored to a conventional pool ladder. In addition, for those pools without a ladder, a separate anchor frame is disclosed. The anchor frame allows the device to be used in virtually any pool. It also allows the device to be used on a dock or on a boat.

6 Claims, 6 Drawing Sheets

ELASTIC SWIMMING EXERCISE DEVICE

BACKGROUND—FIELD OF INVENTION

This invention relates to the field of swimming exercise devices. More specifically, the invention comprises a restraining harness which allows the user to perform swimming strokes in a pool without moving significantly.

BACKGROUND—DESCRIPTION OF PRIOR ART

Swimming restraint harnesses have been in use for some time. U.S. Pat. No. 3,988,020 to Carter (1976) discloses a belt harness intended to be anchored to the side of a pool. The harness has two inelastic cords attached to fixed anchor points. These anchor points must be drilled into the concrete near the edge of the pool. While effective in restraining the swimmer, the Carter device does require disfiguring the pool by installing two permanent anchor points. In addition, the harness assembly is substantially rigid. With a substantially rigid harness, it is difficult for the swimmer to know how much energy he or she is exerting. A preferable arrangement is to have an elastic member in the harness, so that as the swimmer strokes more vigorously, some forward progress is noted.

An elastic harness is disclosed in U.S. Pat. No. 4,109,905 to Meier (1978). The Meier device has a short elastic section near the anchor point which does allow some stretching of the harness. Unfortunately, however, the Meier device also requires a fixed anchor point. Additionally, the harness disclosed is rudimentary and impractical.

A more sophisticated harness is disclosed in U.S. Pat. No. 5,236,404 to MacLennan (1993). The MacLennan device uses a vest type life jacket as a harness, thereby distributing the load on the swimmer's body in a different fashion. The MacLennan invention also provides for attaching the harness to a pool ladder, eliminating the need for dedicated anchor points. The MacLennan device does not, however, have any elastic members in the harness. An additional drawback is that many pools do not have ladders, making it impossible to attach the device. Finally, the use of a vest type life jacket as a harness significantly restricts many swimming strokes.

U.S. Pat. No. 5,601,514 to Horn (1997) addresses the attachment problem with suction cups. This device uses two large suction cups on a substantially rigid plastic frame. The device is intended to work in compression though; i.e., the swimmer is trying to force his way toward the attachment point. This approach would not work if the swimmer swims in the other more conventional direction.

Finally, U.S. Pat. No. 5,816,982 to Croushmore (1998) discloses a radical approach to the anchoring problem. The Croushmore device discloses a collapsible bag used as an anchor. The swimmer fills the bag with water and then drags it up on the side of the pool. The bag anchors a mesh to which is attached the swimming harness. Of course, a swimmer can exert considerable force while exercising. Thus, the bag will need to be quite heavy in order to be an effective anchor. This fact means that the user will have to fill the bag with many pounds of water, making it quite difficult to drag up and over the side of the pool.

The known devices for restraining a swimmer while exercising are therefore limited in that they:

1. Do not provide sufficient elastic extension of the harness in order to allow the swimmer to gauge his or her level of exertion, 2. Require the placement of permanent anchor points in the pool;
3. Require the presence of a pool ladder;
4. Encumber the user in the swimming exercise; and
5. Require the lifting of a heavy bag or other type of anchor.

OBJECTS AND ADVANTAGES

Accordingly, several objects and advantages of the present invention are:

1. To provide sufficient elastic extension of the harness in order to allow the swimmer to gauge his or her level of exertion;
2. To eliminate the need for permanent anchor points in the pool;
3. To eliminate the need for a pool ladder;
4. To not encumber the user in the swimming exercise; and
5. To eliminate the need for an inordinately heavy anchor.

DRAWING FIGURES

REFERENCE NUMERALS IN DRAWINGS

| | |
|---|---|
| 10 pool | 12 ladder |
| 14 upright leg | 16 belt harness |
| 18 flex bow | 20 flexible line |
| 22 anchor frame | 24 anchor leg |
| 26 anchor runner | 28 pool side |
| 30 attach point | 32 collector ring |
| 34 line clip | 36 belt |
| 38 adjustment clasp | 40 trailing flap |
| 42 VELCRO panel | 44 VELCRO harness attach |
| 46 trailing line | 48 harness union |
| 50 harness leader | 52 harness clip |
| 54 stop leg | 56 cooler |
| 58 pool apron | 60 anchor platform |

DESCRIPTION OF THE INVENTION

Figure 1:
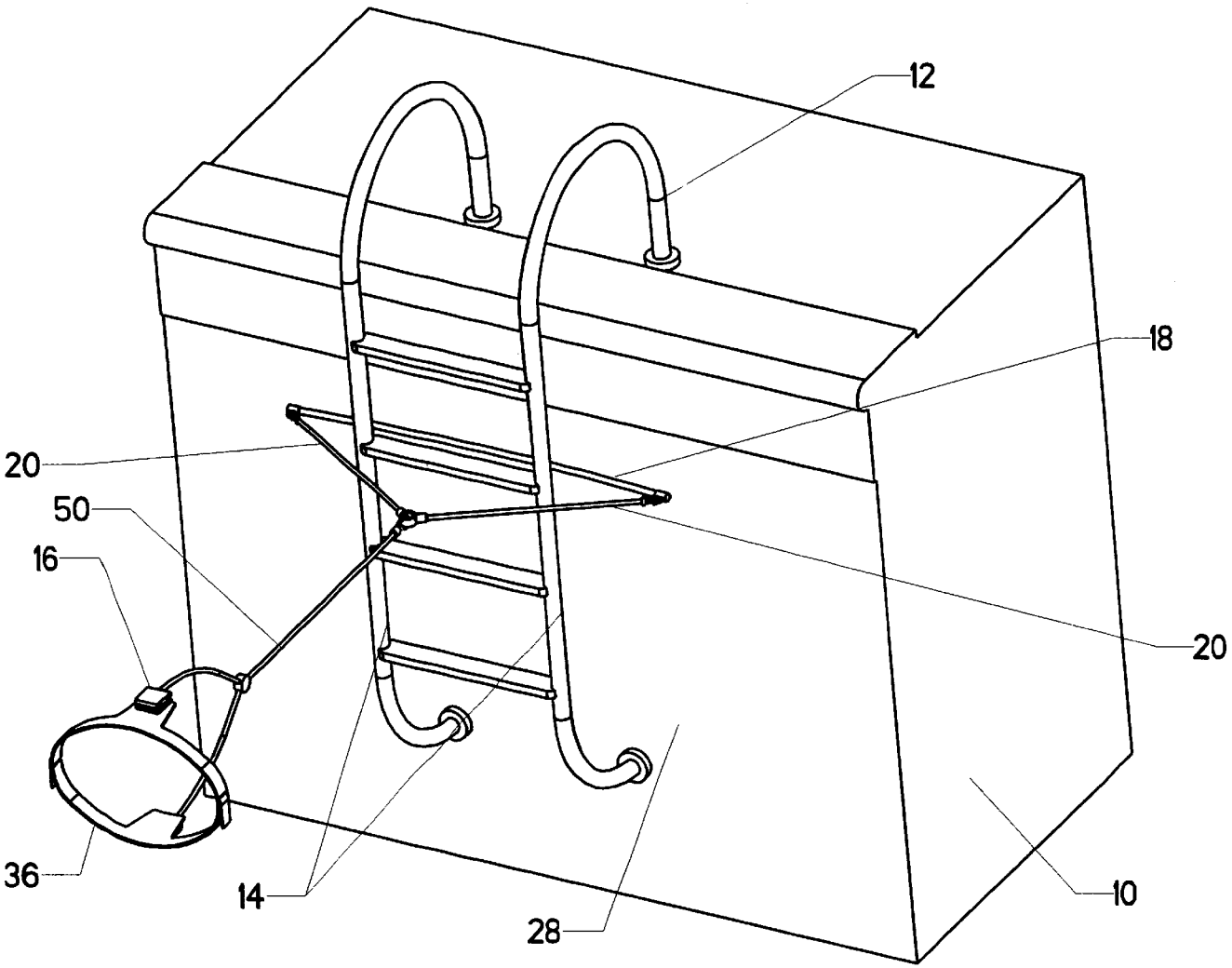
FIG. 1 is an isometric view, showing the proposed invention in a swimming pool.

FIG. 1 depicts a conventional pool 10, having ladder 12 attached to its side. Ladder 12 has two upright legs 14, standing a small distance off of pool side 28. In one embodiment, the present invention utilizes ladder 12 to anchor an exercising swimmer in place.

Flex bow 18 is placed between pool side 28 and upright legs 14. Flex bow 18 is typically oriented horizontally, as shown. Flex bow 18 is in the form of an elastically deformable elongated rod. It has attach points 30 at either end. When force is placed on attach points 30, flex bow 18 will bow in the same fashion as an archer's bow; i.e., it will store energy by elastically deflecting. When force is removed from flex bow 18, it resumes its straight resting position.

Two flexible lines 20 are attached to flex bow 18, one at either end. Belt harness 16 is provided for attachment to the swimmer. Belt harness 16 includes harness leader 50, which joins belt harness 16 to the two flexible lines 20. In the configuration shown, the swimmer would have belt harness 16 cinched tightly about his or her waist, and would be performing a swimming stroke—such as the breast stroke or free-style. The reader will appreciate that as the swimmer attempts to swim away from ladder 12, the force produced by the swimmer is transmitted to belt harness 16, through harness leader 50, and on to flexible lines 20. Flexible lines 20, in turn, pull flex bow 18 against upright legs 14 and begin to bow flex bow 18. The swimmer is thus restrained.

However, the reader should appreciate that while restrained, the swimmer can make some forward progress due to the deflection of flex bow 18. The harder the swimmer strokes, the more deflection results in flex bow 18. Consequently, the more tension is placed on harness leader 50. It is this energy storage mechanism that provides the swimmer with feedback on how much he or she is exerting. It is true that a purely static line will also increase in tension as the swimmer increases his or her exertion. However, the use of an energy storage device such as flex bow 18 actually allows the swimmer to move forward, and this has been found to provide much better feedback.

Figure 2:
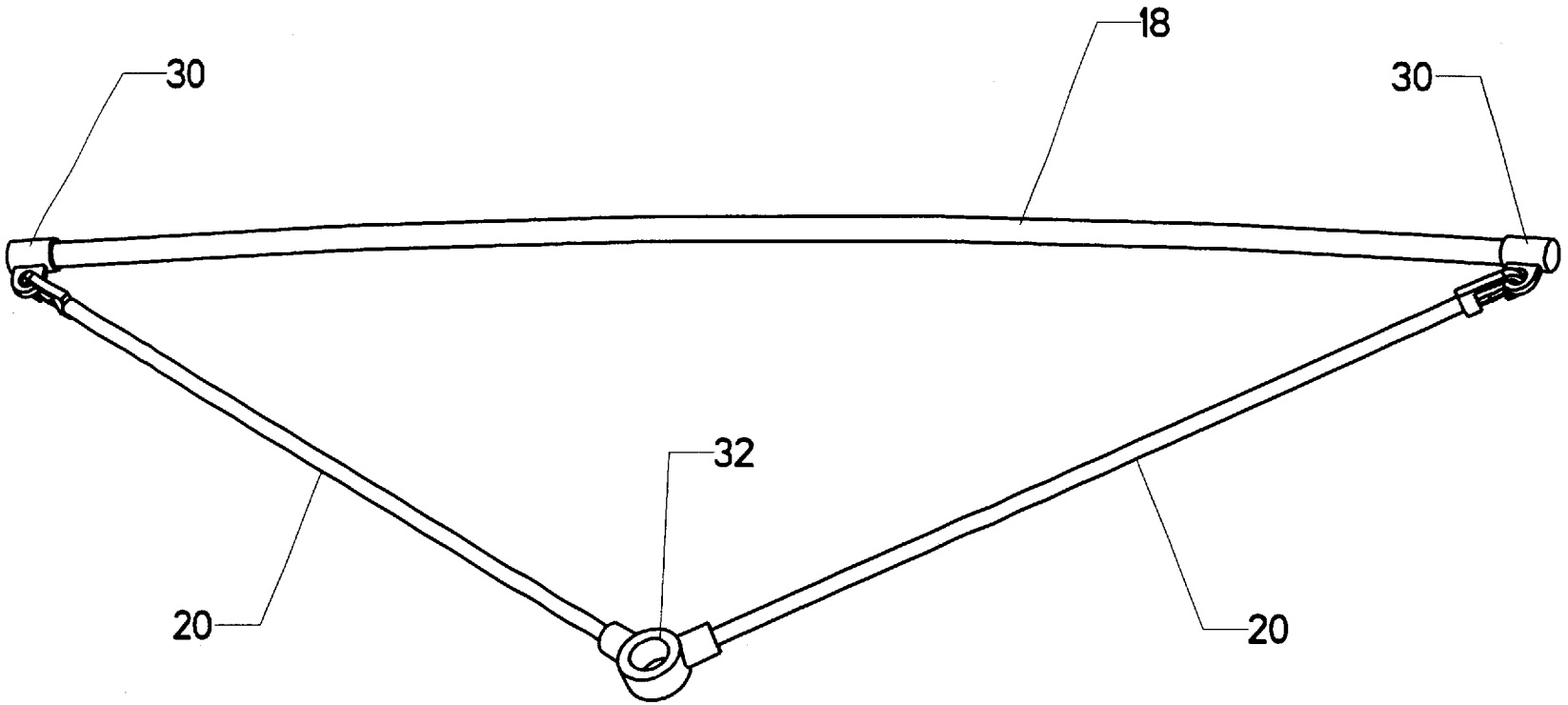
FIG. 2 is a close-up view of the flex bow shown in FIG. 1.
Figure 3:
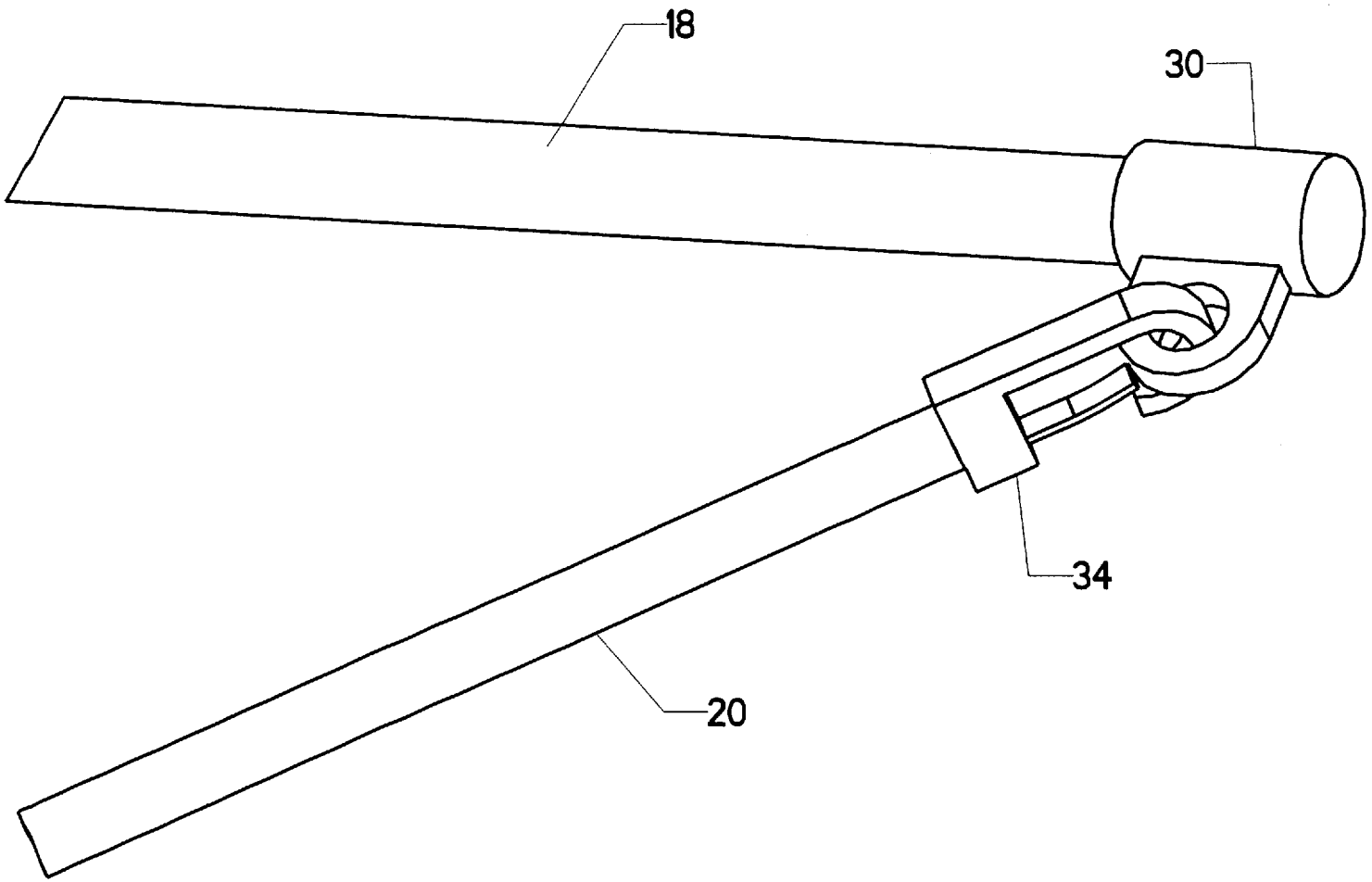
FIG. 3 is a close-up view of the attachment point on the flex bow.

FIG. 2 depicts flex bow 18 and flexible lines 20 in greater detail. Flexible lines 20 are joined by collector ring 32, which provided an attaching point for harness leader 50. FIG. 3 shows attach point 30 in more detail. Attach point 30 is permanently attached to the end of flex bow 18. The reader will observe that it has a ring structure ideal for attaching clips and the like.

Flexible line 20 terminates in line clip 34. Line clip 34 may be easily attached or removed from attachment point 30. This feature allows the user to slip flex bow 18 behind ladder 12, and then attach flexible lines 20. Flex bow 18 is generally held in place by the fact that it floats on the surface of the water. It may optionally be attached to ladder 12 by using bungee cords or the like.

Figure 4:
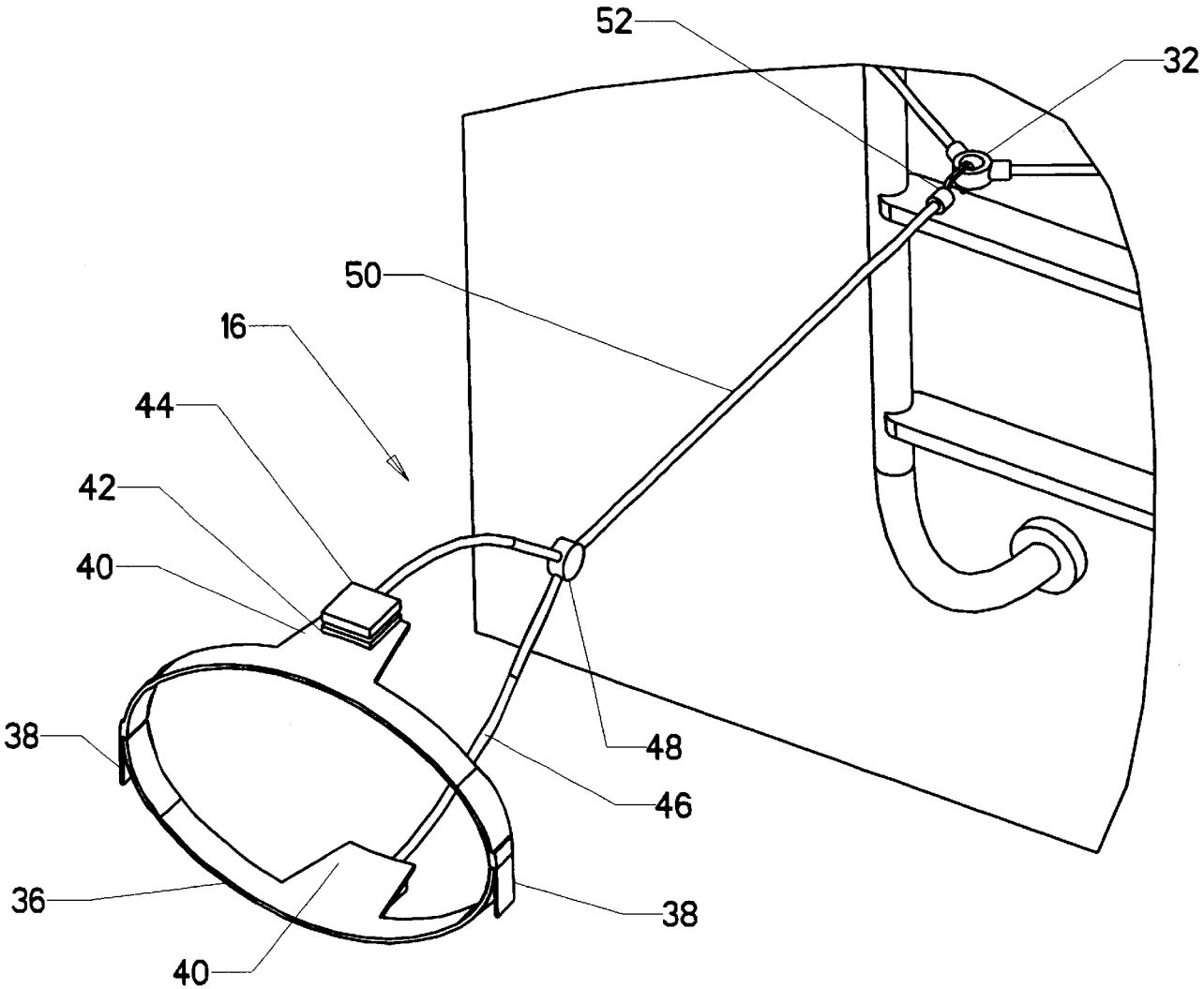
FIG. 4 is a close up view of the belt harness.

FIG. 4 shows more features of belt harness 16. Belt 36 is configured to pass around the swimmer's waist. Two adjustment clasps 38 are provided so that the circumference of belt 36 can be altered to fit a wide variation in waist sizes. An adjustment on each side of belt 36 is needed to ensure the symmetry of the harness attachment points.

Two trailing flaps 40 are provided, typically being formed integrally with the material of belt 36. Each trailing flap 40 has a large VELCRO panel 42. This is provided for attachment to the balance of the harness assembly, as will be explained shortly. In the illustrated orientation, belt 36 would be used for performing a swimming stroke in which the swimmer's body is horizontal, with the chest facing either up or down. For a side stroke, belt 36 would be rotated through 90 degrees. Those skilled in the art will appreciate that the harness illustrated easily allows the swimmer's body to rotate while performing a number of different swimming strokes.

Some water exercises also require the swimmer to stand upright—such as walking or running in the pool. Additional VELCRO attachment points can be provided around belt 36 to accommodate this option. Alternatively, the user can simply rotate belt 36 90 degrees around the body. By doing so, trailing flaps 40 are rotated so that they are proximate the user's hips.

Two trailing lines 46 are joined in harness union 48. Each trailing line 46 terminates in a VELCRO harness attach 44. VELCRO harness attaches 44 are configured to attach to VELCRO panels 42 on trailing flaps 40, thus linking belt 36 to harness union 48.

Harness leader 50 emerges from the other side of harness union 48. It reaches for several feet, giving the swimmer ample clearance from ladder 12. Harness leader 50 terminates in harness clip 52, which removably attaches harness leader 50 to collector ring 32. Thus, the reader will appreciate that the disclosed apparatus attaches the swimmer to flex bow 18, which is held in place by ladder 12. This is the preferred embodiment of the invention.

Figure 5:
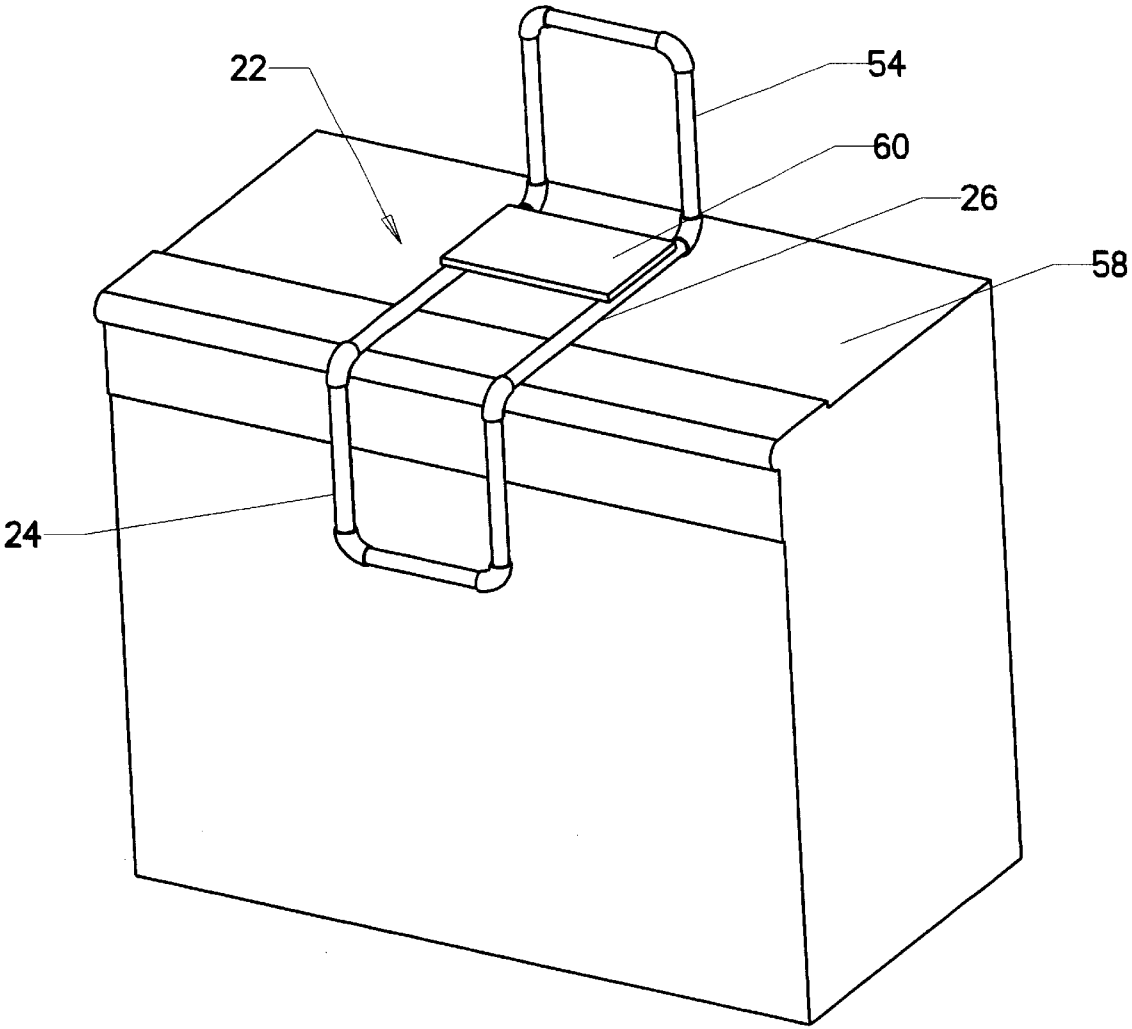
FIG. 5 is an isometric view of the anchor frame.

Of course, not all pools are equipped with a ladder. It is therefore necessary to have an alternate method of anchoring the apparatus. FIG. 5 discloses one such alternate apparatus. Anchor frame 22 is provided for the attachment of flex bow 18. Anchor frame 22 has two anchor legs 24 extending downward into pool 10. It also has two anchor runners 26, extending along pool apron 58. At the point furthest from pool 10. Anchor frame 22 has two upright stop legs 54. Anchor frame 22 can be made from many different materials.

The particular embodiment illustrated is made from 2 inch PVC piping. The pipe may be joined together using pipe cement and PVC elbows. However, it is also possible to omit the pipe cement. PVC segments are typically slip-fit into each other. There is sufficient friction in the slip fit to avoid the need for using pipe cement. Thus, anchor frame 22 may be employed without cementing the pieces together. This embodiment has the added benefit of portability. Once the user is finished with anchor frame 22, he or she can quickly disassemble the components and place them in a storage bag. The disassembled version is obviously much more convenient to transport and store.

Figure 6:
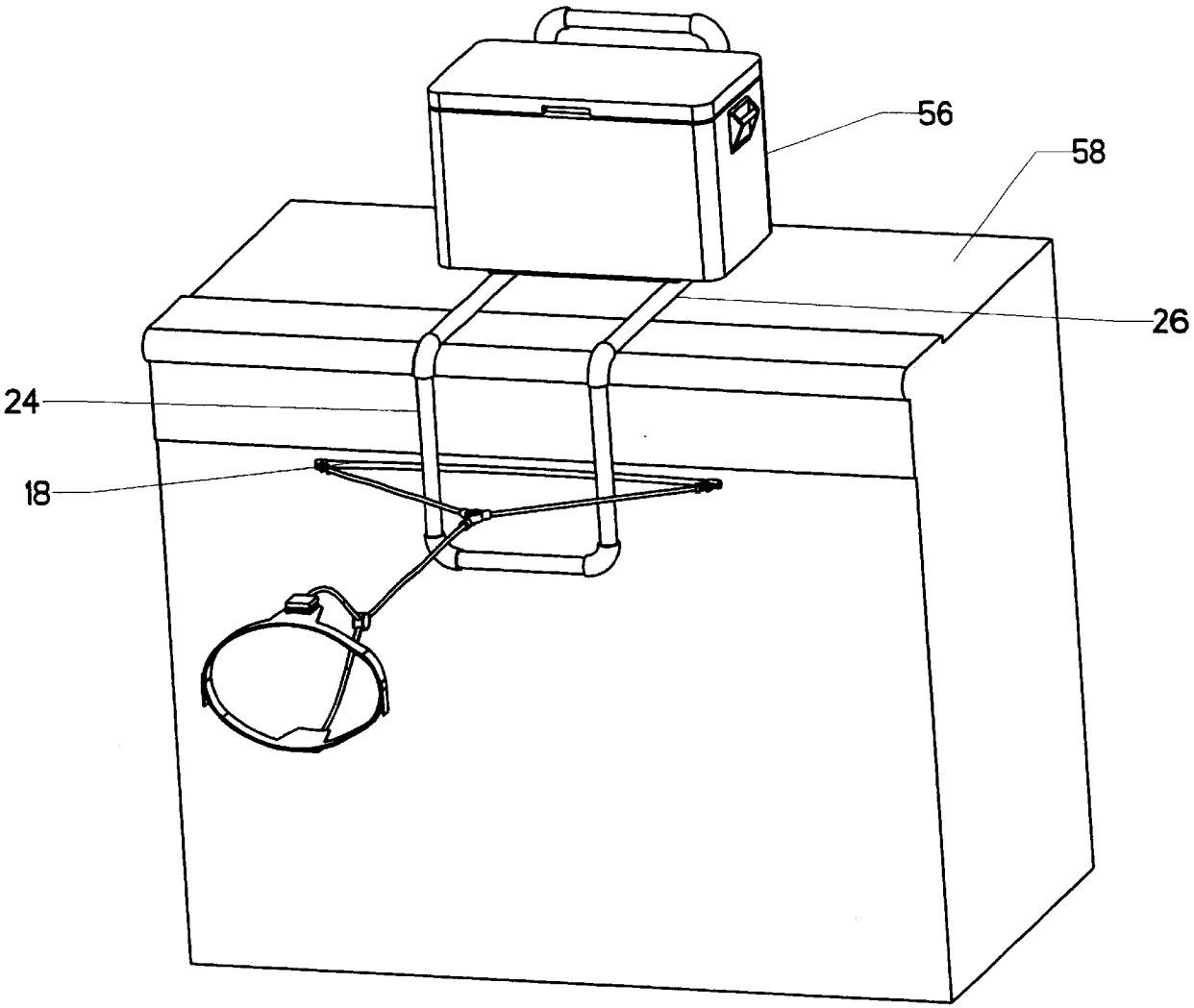
FIG. 6 is an isometric view of the anchor frame with a cooler in place for added weight.

Turning now to FIG. 6, the use of anchor frame 22 will be explained. Anchor frame 22 is placed on the side of pool 10 as shown. Flex bow 18 is placed between anchor legs 24 and pool side 28, in much the same fashion as with ladder 12. The remainder of the swimmer harnessing apparatus is identical to the previous disclosure. The reader will readily appreciate, however, that the swimmer would easily drag anchor frame 22 into the pool unless it is held in place by significant weight. It is therefore necessary to place weight on anchor frame 22 to lock anchor runners 26 against pool apron 58. Many different objects could be used for weight. In this particular illustration, cooler 56 has been used—since coolers are often found near pools. Two stop legs 54 are provided to bear against cooler 56, or other objects used.

Turning back to FIG. 5, anchor platform 60 is provided to evenly distribute the load of an object placed on anchor frame 22. Using anchor frame 60, it is also easy and convenient for a second person to stand upon anchor frame 22 in order to hold it in place. This option is particularly suited to a coaching situation where a swimming coach wishes to observe the technique of a student.

Those skilled in the art will realize that many types of objects can be used to hold anchor frame 22 in place. Thus, anchor frame 22 allows the invention to be used in virtually any type of pool. No particular anchor point or fixture within the pool is needed. In addition, anchor frame 22 also allows the device to be used on a dock, such as would commonly be found in a river or pond. The device may also be used on certain types of boats.

Returning now to FIGS. 1 through 3, the particular materials used in the construction of the components will be discussed. The material selected for flex bow 18 is obviously important. It must be capable of repeatedly flexing without undergoing plastic deformation. It must also be capable of withstanding pool chemicals. Many types of flex bows are presently in use—such as those found on strength training equipment. These are suitable for use in the present situation. A hollow PVC tube has also been found to be satisfactory. A thick-walled schedule of PVC tubing is preferable, in order to prevent buckling. This PVC tube is capable of deflecting significantly without buckling, thereby allowing the swimmer to advance a significant distance before reaching the point where he or she can stretch the system no further.

Flexible lines 20 can be made of elastic or inelastic materials. Making this component from an elastic material, such as rubber tubing, allows the entire system to stretch even further. The same can be said of harness leader 50. If it is made of an elastic material as well, the system can stretch even further.

Belt 36 must be comfortable for the swimmer to wear, yet still be capable of transmitting significant loads. Nylon webbing has been found suitable for this component. Several molded plastic components are utilized. These are: harness union 48, harness clip 50, collector ring 30, and line clips 34. Many different types of molding plastics may be used for these components. However, it should be kept in mind that the material must be capable of withstanding prolonged exposure to sunlight, it must be capable of withstanding prolonged exposure to pool chemicals, and it must resist excessive water absorption.

Summary, Ramifications, and Scope

Accordingly, the reader will appreciate that the proposed invention allows a swimmer to exercise within a pool without moving significantly, yet still allows the swimmer to gauge his or her level of exertion. The invention has further advantages in that it:

1. Eliminates the need for permanent anchor points in the pool;
2. Eliminates the need for a pool ladder;
3. Does not encumber the user in the swimming exercise; and
4. Eliminates the need for an inordinately heavy anchor.

Although the preceding description contains significant detail, it should not be construed as limiting the scope of the invention but rather as providing illustrations of the preferred embodiments of the invention. For example, many different types of attaching devices could be substituted for line clips 34 and harness clip 50, different attachment devices could be substituted for VELCRO panels 42, etc. Thus, the scope of the invention should be fixed by the following claims, rather than by the examples given.

Having described my invention, I claim:

1. A swimming exercise apparatus intended to maintain a swimmer relatively stationary in a pool by linking said swimmer to the upright legs of a ladder on the side of said pool, comprising:

a. a belt harness attached to said swimmer around said swimmer's waist;

b. a flex bow, having a first end and a second end, and being placed between said upright legs of said ladder and said side of said pool;

c. a first flexible line, having a first end and a second end, wherein said first end is attached to said first end of said flex bow and said second end is attached to said belt harness; and d. a second flexible line, having a first end and a second end, wherein said first end is attached to said second end of said flex bow and said second end is attached to said belt harness, so that as said swimmer attempts to swim away from said ladder said first and second flexible lines are placed in tension, said flex bow is drawn against said upright legs, and said flex bow begins to bow.

2. The device as recited in claim 1, wherein said flex bow is a long slender rod, capable of bending substantially without undergoing plastic deformation.

3. The device as recited in claim 1, wherein said belt harness further comprises:

a. a collector ring, joining said second end of said first flexible line together with said second end of said second flexible line;

b. a harness union;

c. a harness leader, removably connecting said harness union to said collector ring;

d. a belt, adjustably attached to the waist of said swimmer; and e. detachable and adjustable means for connecting said belt to said harness union.

4. A swimming exercise apparatus intended to maintain a swimmer relatively stationary in a pool by linking said swimmer to the side of said pool, comprising:

a. a belt harness attached to said swimmer around said swimmer's waist;

b. an anchor frame, having at least one anchor leg descending into said pool adjacent said side of said pool and at least one anchor runner running along said apron of said pool so as to frictionally hold said anchor frame in place;

c. a flex bow, having a first end and a second end, and being placed between said anchor leg of said anchor frame and said side of said pool;

d. a first flexible line, having a first end and a second end, wherein said first end is attached to said first end of said flex bow and said second end is attached to said belt harness; and e. a second flexible line, having a first end and a second end, wherein said first end is attached to said second end of said flex bow and said second end is attached to said belt harness, so that as said swimmer attempts to swim away from said anchor frame and said first and second flexible lines are placed in tension, said flex bow is drawn against said anchor leg and said flex bow begins to bow.

5. The device as recited in claim 4, wherein said flex bow is a long slender rod, capable of bending substantially without undergoing plastic deformation.

6. The device as recited in claim 4, wherein said belt harness further comprises:

a. a collector ring, joining said second end of said first flexible line together with said second end of said second flexible line;

b. a harness union;

c. a harness leader, removably connecting said harness union to said collector ring;

d. a belt, adjustably attached to the waist of said swimmer; and e. detachable and adjustable means for connecting said belt to said harness union.

* * * * *